United States Patent [19]

Gray et al.

[11] Patent Number: 4,637,794

[45] Date of Patent: Jan. 20, 1987

[54] PULSE COMBUSTION DRYING APPARATUS FOR PARTICULATE MATERIALS

[76] Inventors: Robert R. Gray, 7110 Via Monte Mar, Gladstone, Oreg. 97027; Val M. Marguth, 10015 SW. Kennedy St., Beaverton, Oreg. 97005

[21] Appl. No.: 783,860

[22] Filed: Oct. 3, 1985

[51] Int. Cl.[4] ..... F27B 15/00; F27D 7/00; F23C 11/04

[52] U.S. Cl. ..... 432/58; 431/1; 432/25

[58] Field of Search ..... 432/25, 58; 431/1

[56] References Cited

U.S. PATENT DOCUMENTS 2,838,869 6/1958 Desbenoit et al. ..... 239/587
3,194,295 7/1965 Marchal et al. ..... 431/1

*Primary Examiner*—John J. Camby

[57] ABSTRACT

Pulse combustion apparatus for the drying of particulate material having the combustion chamber and the exhaust system components that direct the exhaust gas into a settling and collection chamber disposed on a common longitudinal axis and wherein the volume of back flow gas flowing through an adjacent augmenter duct is utilized to control the dew point within the settling and collection chamber.

9 Claims, 4 Drawing Figures

10
10'
12
14
16
18
20
22
24
26
28
30
32
34
36
40
42
44
46
48
50
52
54
56
58
60
62
64
66
68
70
72
74
76
78
84
116

PULSE COMBUSTION DRYING APPARATUS FOR PARTICULATE MATERIALS

This invention relates to the drying of particulate material and more particularly to improved methods and apparatus for the pulse combustion drying of particulate material.

BACKGROUND OF THE INVENTION

Pulse combustion drying, employing a pulse combustor essentially similar in nature to a pulse jet engine, is a relatively recent but recognized technique for effecting the drying of particulate materials. Illustrative of some earlier endeavors in pulse jet field for drying and other purposes are U.S. Pat. Nos. 3,618,655; 4,226,668; 4,226,670; 4,265,617 and 2,838,869. In the first of these patents a plurality of pulse jet engines are mounted at the base of a vertical chamber. A paste or slurry of the particulate material to be dried is introduced into the exhaust duct of such pulse jet engines which function to at least partially dry the particulate material and introduce it into the chamber where induced vortex gas flow causes circulation of the particulate material and consequent opportunity for further drying thereof. In the latter of these patents a linear pulse jet engine assembly for projecting various types of materials is disclosed.

A current state of the art pulse combustion dryer is made and sold by Sonodyne Industries of Portland, Oreg. The pulse combustor unit, which is the heart of the drying system, is a specially contoured and generally U-shaped hollow tube whose dimensions and materials of construction determine its operation. The pulse combustion process is initiated when air and fuel from a constant low pressure supply thereof are drawn into the combustion chamber portion of the combustor and ignited by a spark. Hot gases created by the resulting detonation move in both directions from the combustion chamber. In one direction, they pass through an inlet nozzle and adjacent air augmenter, and in the other direction, through U-shaped exhaust section and past a raw material injection port at the downstream end thereof. Detonation in the combustion chamber causes the pressure therein to rise, momentarily shutting off the fuel supply. As the combustion chamber pressure falls following detonation, fuel is again admitted and mixed with air being drawn through the inlet nozzle. Detonation occurs again, either because of contact between the explosive air-fuel mixture and the spark or by contact with the sufficiently hot wall of the chamber itself. Once the wall temperature reaches approximtely 1800°0 F., the spark can be extinguished and the process becomes self-igniting.

The pressure fluctuation, which causes the pulsing behavior of the combustor, results in strong standing waves of sound energy which move in both directions from the chamber. Repeated detonations also create high speed displacement of hot gases with about 90% thereof existing through the tailpipe and associated exhaust system components. Introduction of moisture laden particulate material into the downstream end of the exhaust section subjects such material to the sound waves which, although not fully understood, are believed to break the bonds between the solid particulate matter and the liquid, most often water, and in an atomization of the water into fine droplets with a consequent increase in surface area for evaporation. The heat present in the exhaust gas interacts with the atomized cloud of introduced raw material allowing highly efficient evaporation to occur. During drying, the rapid evaporation of the water absorbs most of the heat and the solid particulates are maintained and exit in a relatively cool state. It should be noted that while operating temperatures in the pulse combustion exhaust system exceed 2500° F., the residence time of the raw product solids in contact with the exhaust gases is very short, being in the order of a few milliseconds. Because of such short residence time and the high heat consumption effected by evaporation, the temperatures of the dried solid particulates rarely exceeds 100° to 150° F.

While pulse combustion drying apparatus of the type described immediately above has proved to be both efficient and economical in the drying of many diverse materials, the basic U-shaped configuration of the combustion chamber and downstream exhaust portions thereof has created certain assembly and maintenance problems as well as introducing certain system instabilities.

SUMMARY OF THE INVENTION

This invention may be briefly described as an improved construction for pulse combustion drying apparatus and which includes, in its broad aspects, the provision of an improved pulse combustion dryer system wherein the inlet nozzle, combustion chamber, tailpipe and drying cone have a common straight line axis. In a narrower aspect, such improved straight line pulse combustion drying apparatus includes an auxiliary and elongate gas augmenter and the utilization of hot gas delivered therefrom to control system operating parameters, such as dew point suppression in the collecting chamber.

Among the advantages of the subject invention is the provision of improved stability and efficiency of pulse combustor dryer operation. Other advantages include a marked simplicity of assembly, a reduction in wear and maintenance and increased economies of operation. Still further advantages flow from the use of an elongate air augmenter system which permits beneficial utilization of the relatively cooler air exiting therefrom at any one of a plurality of locations with an exhanced performance and flexibility of dryer operations.

The object of this invention is the provision of an improved construction for pulse combustor drying apparatus.

Another object of this invention is the provision of an improved linear construction for pulse combustor drying apparatus in association with an elongate air augmenter system that permits multiple utilization of the air exiting therefrom.

A further object of this invention is the provision of an improved air augmentation system for pulse combustor dryers that expands the flexibility and scope of usage thereof.

Other objects and advantages of the subject invention will be apparent from the following portions of this specification and from the appended drawings which illustrate, in accord with the mandate of the patent statutes, a presently preferred construction for a pulse combustor drying apparatus incorporating the principles of this invention.

Figure 1:
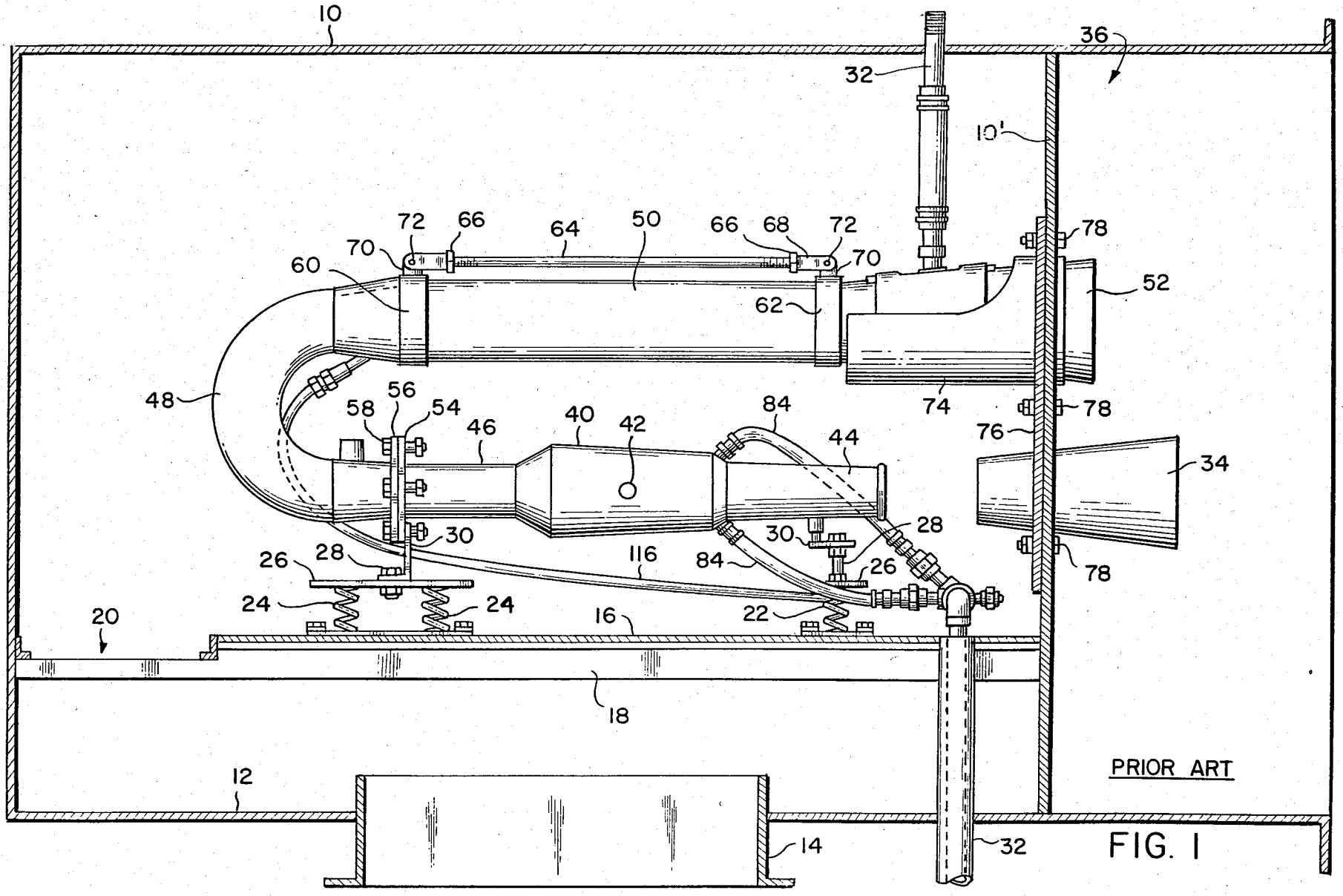
PRIOR ART FIG. 1
FIG. 1 is a schematic side elevation of a prior art pulse combustor drying system.

Referring initially to FIG. 1, the prior art pulse combustor dryer system there depicted broadly includes an isolating enclosure 10, desirably of double walled soundproof character, having an air inlet conduit 14 on the bottom wall 12 thereof. Disposed within the enclosure 10 is a platform 16 supported on beams 18 in uniform spaced relation to the enclosure bottom wall 12 and forming an inlet air plenum therebetween. The rearward end of the platform 16 terminates short of the rear wall of the enclosure 10 to provide an opening 20 for the passage of air upwardly from the air inlet conduit !4.

Also as illustrated, the pulse jet combustor is mounted in a resilient manner above the support platform 16 so as to cushion the platform and enclosure walls from vibrations incident to the operation of the combustor. Resilient mountings such as a front coil spring 22 and a rear pair of coil springs 24 extend upward from the platform 16, and support mounting plates 26 at their upper ends. Bolts 28 secured removably to the plates 26 serve to secure thereto brackets 30 which connect to and serve to support the front and rear portions of the combustor.

The pulse jet combustor includes a combustion chamber 40 of enlarged diameter provided with a spark plug 42 or other ignition means for igniting a combustible fuel air/mixture. Connected to the combustion chamber 40 is an air inlet conduit 44 which receives atmospheric air from within the enclosure 10, and a combustion gas outlet conduit generally shown at 46.

The combustion gas outlet conduit 46 communicates through an arcuate and generally U-shaped coupling section 48 with a tailpipe 50 which, in turn, communicates at its downstream or exhaust outlet end with a materials dehydration section 52.

In the illustrated embodiment, the combustion gas outlet conduit 46 of the combustion chamber section 40 is provided at its downstream or outlet end with a peripheral flange 54 arranged for removable connection to a corresponding flange 56 at the adjacent upstream or inlet end of the U-shaped coupling or transition section 48, as by means of a plurality of bolts 58. The downstream end of the coupling section 48 is fitted with an outer, forwardly projecting annular collar 60 dimensioned to freely receive therein the adjacent upstream end of the tailpipe section 50.

The downstream end of the tailpipe section 50 is, in similar manner, freely received within an enlarged collar 62 secured to and extending rearwardly of the upstream end of a dehydration section 52 in the form of a hollow truncated cone and generally called a "drying cone". To facilitate tailpipe replacement the collars 60 and 62 are interconnected by a turnbuckle assembly which includes an elongated threaded rod 64 received at its opposite ends in threaded nuts 66. Each nut is secured to a pair of laterally spaced lugs 68 which receive between them an ear 70 extending upwardly from the associated collar. Registering openings in the lugs and ears receive a pivot pin 72 for joining them together.

The dehydration section 52 is supported in a saddle member 74 which is secured to and extends through a mounting plate 76. The mounting plate 76 is secured removably to a wall 10' of the enclosure, as by bolts 78. As is apparent, the dehydration cone 52 terminates within an adjacent collector room 36 wherein the majority of the dried particulates settle out and are collected in any suitable manner. A duct collector or other conventional particulate collecting device is usually connected to the gas exhaust system for such collecting chamber or room 36 to effect recovery of substantially all of the dried particulates.

A wet product inlet conduit 32 is connected to the dehydration cone 52 for introduction of the wet product into the cone in a direction substantially perpendicular to the direction of movement of the high velocity gases of combustion passing through the tailpipe and exiting from the downstream end of the dehydration cone.

Combustible fuel, such as oil, gas, etc. is delivered to the combustion chamber 40 by one or more fuel supply lines, such as the two lines 84 illustrated, connected to the fuel inlet conduit 32.

The plate 76 supporting the dehydration cone saddle 74 also supports a so called "augmenter" in the form of a hollow truncated cone 34 disposed in spaced axial alignment with the air inlet portion 44 of the combustion chamber 40 and which also extends through the forward engine room wall 10'. In the described system, the augmenter 34 functions to direct the high velocity combustion gases emitted as back pressure from the combustion chamber 40 and air inlet conduit 44 into the adjacent collector room 36.

In the operation of the above described pulse combustor system, the combustor is activated by delivery of combustible fuel and air to the combustion chamber 40 where it is ignited by a spark from the plug 42. A wet product in the form of a slurry, paste or moist particulates is fed, generally under pressure, through the material inlet conduit 32 from whence it enters the dehydration cone 52 in a direction substantially perpendicular to the direction of flow of high velocity combustion gases through the dehydration cone.

Figure 2:
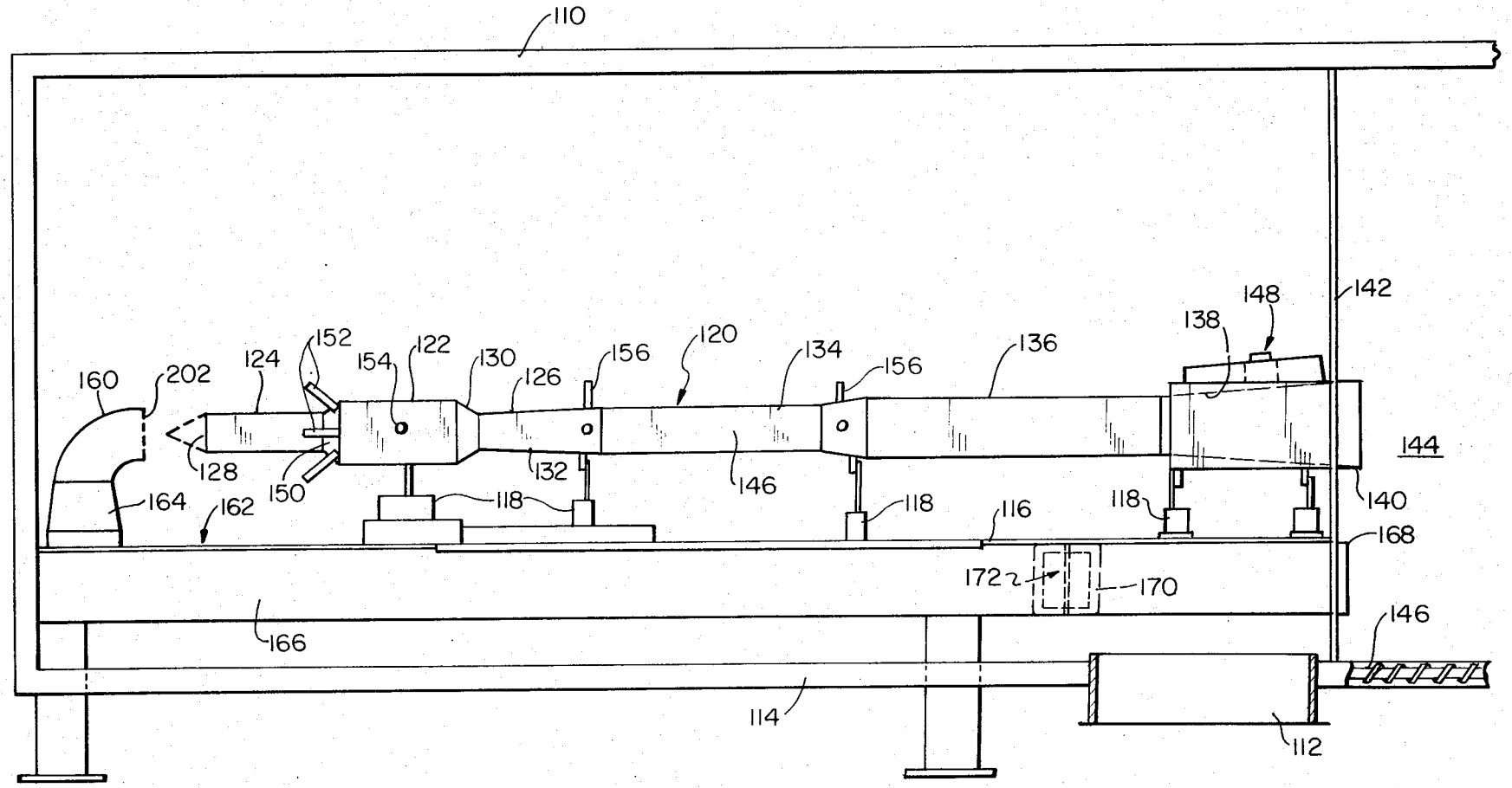
FIG. 2 is a schematic side elevation of an improved construction for a pulse combustor drying system incorporating the principles of this invention.

Referring now to FIG. 2, the improved pulse combustor dryer system includes an enclosure 110, again preferably of double walled soundproof construction, having an air inlet conduit 112 in the floor 114 thereof. Disposed within the enclosure 110 is a platform 116 having a plurality of pedestals 118 for supporting the pulse combustor assembly, generally designated 120. The combustor assembly 120 is of circular cross section with its horizontal axis disposed in spaced parallel relation with the platform 116. The pulse combustor assembly here includes a combustion chamber 122 having an air inlet conduit 124 on one side thereof and a combustion gas outlet conduit 126 on the other side thereof. The air inlet conduit is of slightly tapered configuration with the diameter thereof increasing from its open end 128 to its juncture with the combustion chamber 122. The combustion gas outlet conduit 126 is of general venturi configuration having a sharply converging entry section 130 adjacent the combustion chamber 122 and a downstream or delivery section 132 of progressively increasing diameter.

The exit end of outlet conduit 126 is connected to an elongate transition section 134 which in turn is connected to an elongate tailpipe 136. The downstream or delivery end of the tailpipe 136 is connected to the entry portion of a drying cone section 138 whose downstream end 140 extends through a bulkhead wall 142 of the enclosure 110 and into an adjacent collector room 144.

In contradistinction to the device shown in FIG. 1 and described earlier, the improved pulse combustor unit has all of its component elements, i.e. air inlet conduit 124, combustion chamber 122, gas outlet conduit 126, transition 134, tailpipe 136 and drying cone 138 located in a straight line with a common longitudinal axis 146.

Disposed intermediate the air inlet conduit 124 and the combustion chamber 122 is a transition wall section 150 of sharply increasing diameter that defines a portion of the combustion chamber 122. Mounted in uniform spaced relation in such wall section 150 are a plurality, preferably four, fuel nozzles 152, so positioned to inject fuel into the combustion chamber 122 so that the injected fuel streams are focused on said axis 146 at a common location well within the chamber 122. The angle of fuel entry affects combustion rate and angles of fuel entry in the range of 30° to 50° relative to the longitudinal axis 146 have proved useful. In general, the lower the angle the greater is the burn rate. Many different types of combustible fuels, such as oil, gasoline, kerosene, propane, natural gas and the like, are suitable for use in the described pulse combustor. Also included are one or more auxiliary fuel nozzles 154 mounted in the side wall of the combustion chamber 122 and focused at the axis 146 at a common location downstream of the convergence point of fuel from nozzles 152 so as to provide, where necessary for certain fuels such as natural gas, a more uniform fuel/air mixture for combustion therewithin.

Disposed at the junction of the combustion gas outlet conduit 126 and the upstream end of the transition 134 and at the junction between the transition 134 and tailpipe 136 are one or more afterburner fuel nozzles 156. Such afterburner nozzles 156 serve, again for particular fuels such as natural gas, to provide additional heat to the exhaust gas stream.

The dehydration or drying cone 138 is of frusto conical configuration with its larger diameter end 140 extending through a bulkhead wall 142 into an adjacent particulate settling and collection chamber 144. The collected particulates are removed from the chamber 144 by any suitable means such as an auger 146 or other solids conveying unit disposed in the bottom thereof. The chamber 144 is vented to the atmosphere through a bag type duct collector or the like.

Disposed in spaced relation and coaxial alignment with the air inlet conduit 124 is the open end of an elbow shaped entry section 160 of an "augmenter" assembly, generally designated 162. The elbow shaped entry section 160 is connected to a vertical conduit section 164 of expanding cross section, which in turn is connected to an elongate conduit section 166 disposed beneath the platform 116. The elongate conduit section is positioned essentially parallel to the axis 146 of the combustor assembly and has its downstream end 168 extending through the bulkhead wall 142 within the settling and collection chamber 144.

Such elongate delivery conduit 166 permits both control of amount and intended usage of the combustion chamber back flow gases flowing through the augmenter system. As schematically depicted the conduit 166 also contains a branch conduit 170 and a flow regulating damper 172. The position of the damper 172 will control the relative volumes of back flow gas delivered into the collecting chamber 144 or diverted through the branch conduit 170. As will be apparent the back flow gas can be used for any desired purpose in accord with the velocity and temperature thereof or can be vented to the atmosphere.

In the operation of the subject device, wet particulate material is introduced through a conduit 148 into the dehydration cone 138 in a direction substantially perpendicular to the direction of movement of the high velocity gases of combustion passing through the tailpipe 136 and exiting into the settling and collecting chamber 144. The temperature of the exiting combustion gases at the point of wet material introduction is in the order of 2000° to 3000° F. As previously pointed out, the subjection of the introduced wet particulate material to the sound waves attendant pulse combustor operation is believed to break up the bonds between the solid particulates and the liquid, most often water, and in an apparent atomization of the liquid into fine droplets with a consequent increase in surface area for evaporation. The high temperature gas interacts with the atomized cloud of introduced raw material allowing highly efficient evaporation to occur as evidenced by a reduction in the exit gas temperature to about 200°–300° F. and relatively cool water free solid particulates. Such efficient evaporation however results in the temperature of the gas entering the settling and collection chamber being close to its dew point. In order to avoid undesired moisture condensation within the collection chamber 144 the venting of the augmenter section into the chamber 144 may be controlled, for example, to effect a dew point suppression therein and to thereby insure delivery of a dry product.

The herein disclosed straight line pulse combustor construction not only provides for an increased stability of operation but also appears to improve the efficiency of the system. Additionally, the disclosed straight line construction eliminates undesired local hot spots, such as at the U-shaped coupling section 48 in the unit of FIG. 1 but also makedly reduces wear and required maintenance as well as simplifying assembly and disassembly operation.

Figure 3A:
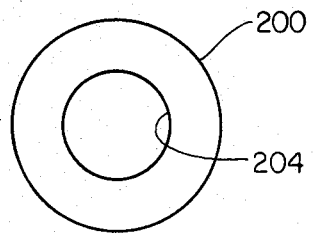
FIGS. 3*a* and 3*b* are plan and oblique views of air restrictor plates for the augmenter inlet.

FIG. 3*a* schematically depicts, in plan view a flow restrictor plate 200 adapted to be mounted at the entry to the augmenter system as, for example, at the open end of the elbow shaped entry section 160 as depicted by the dotted lines 202 on FIG. 2. The flow restrictor plate 200 can be of solid nature when it is desired to preclude gas entry entirely into the augmenter system or can contain an aperture 204 of appropriate diametric dimension in accord with a desired volume of gas flow through the augmenter system.

As will be apparent, a restrictor device of the type described can be used with any type of augmenter system to control the amount of both back flow secondary exhaust gas and the amount of ambient air introduceable into the augmenter. Restriction of ambient air is desirable when the materials being dried are of combustible character and it is desired to restrict the amount of combustion supporting oxygen in its vicinity. Additionally, such restriction of augmenter gas flow permits more economic operation of downstream dust collectors such as a bag house type filter through reduction of gas volumes to be passed therethrough.

Figure 3B:
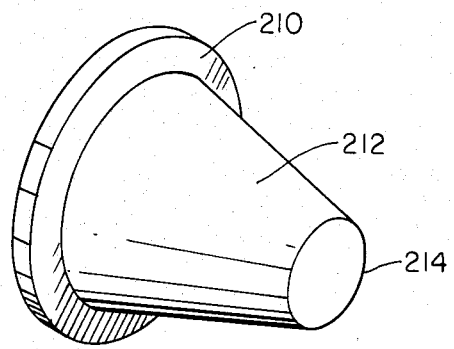

FIG. 3*b* shows another embodiment of a restrictor plate adapted to limit the amounts of induced ambient air introduceable into the augmenter. In this embodiment the restrictor plate 210 includes a conical entry section 212 terminating in an aperture 214 of predetermined diameter. In the operation of this restrictor the aperture 214 is selected, for a given spatial relationship with an air inlet conduit, to permit passage of only a core portion of the jet of back flow exhaust gas emanating from the combustion chamber air inlet conduit into the augmenter. The sloping side walls of the cone 212 not only function to direct the peripheral portions of the back flow gas stream but also function to minimize the inductive flow of ambient air into the augmenter system.

We claim:

1. Improved pulse jet combustor apparatus for the drying of particulate material comprising:

a pulse jet combustor enclosure and an adjacent particulate settling and collection chamber, said pulse jet combustor enclosure having disposed therein a pulse jet combustor including, a combustion chamber, an air inlet conduit connected to one end thereof, a primary exhaust outlet conduit connected to the other end thereof, an elongate tailpipe section disposed downstream of said exhaust conduit and a frusto-conically shaped drying section connected intermediate said tailpipe section and said settling and collection chamber, said inlet conduit, combustion chamber, outlet conduit, tailpipe and drying sections having a common linear longitudinal axis and defining a continuous closed gas combustion and exhaust system, means for introducing particulate material to be dried into said drying section for transmittal into said settling and collection chamber, an augmenter duct disposed in substantially parallel spaced relation with the longitudinal axis of said air inlet conduit, combustion chamber, outlet conduit, tailpipe end drying sections having an upstream and positioned to receive secondary back flow exhaust gas emanating from said inlet conduit and a downstream end connected to said settling chamber for introduction of said back flow gas therein, and means for regulating the volume of back flow gas introduced into said settling and collecting chamber from said augmenter duct for controlling the dew point therein.

2. The improved pulse jet combustor apparatus as set forth in claim 1 wherein said means for controlling the volume of back flow gas introduced into said settling and collection chamber comprises a back flow gas diversion duct and damper means for regulating the relative volumetric flow of back flow gas through said augmenter and diversion ducts.

3. The improved pulse jet combustor as set forth in claim 1 further including:

primary fuel introduction nozzle means located at the juncture of said air inlet conduit and said combustion chamber for focused introduction of fuel at a predetermined location within said combustion chamber and auxiliary fuel introduction nozzle means for introduction of fuel into said combustion chamber downstream of the locus of primary fuel introduction.

4. The improved pulse jet combustor as set forth in claim 1 further including afterburner fuel injection nozzle means for introduction of fuel into the combustion chamber exhaust stream downstream of the exhaust gas outlet conduit thereof.

5. The improved pulse jet combustor apparatus as set forth in claim 1 wherein said means for regulating the volume of back flow exhaust gas into said augmenter duct comprises a restrictor plate having an aperture of predetermined diametric extant mounted at the input thereof.

6. In pulse jet combustion apparatus for the drying of particulate material of the type having a combustion chamber having an air entry end, an exhaust end and a common longitudinal axis therebetween, an air inlet conduit coaxially connected to the air entry end thereof, a primary exhaust gas conduit coaxially connected to the exhaust end thereof and, a tailpipe coaxially connected to the end of said exhaust gas conduit for directing the exhaust gases past a locus of particulate material introduction and to a dried particulate receiving chamber the improvements comprising a plurality of primary fuel nozzles mounted at the air entry end of said combustion chamber downstream of said air inlet conduit and positioned to direct combustible fuel to a common location on the longitudinal axis of said combustion chamber spaced a predetermined distance from the air entry end thereof.

7. Pulse jet combustion apparatus as set forth in claim 6 wherein said plurality of fuel nozzles deliver a stream of fuel into said combustion chamber at an angle of 30° to 50° relative to said longitudinal axis.

8. Pulse jet combustion apparatus as set forth in claim 6 further including at least one auxiliary nozzle mounted on said combustion chamber and positioned to direct combustible fuel to a location on said longituidnal axis there is predetermined spaced relation to the locus of convergence of fuel emitted from said primary fuel nozzles.

9. Pulse jet combustion apparatus as set forth in claim 6 further including at least one afterburner feed nozzle positioned to introduce combustible fuel into the exhaust gas flowing through said primary exhaust gas conduit and said tailpipe.

* * * * *